US010710790B2

(12) United States Patent
Aksan et al.

(10) Patent No.: US 10,710,790 B2
(45) Date of Patent: Jul. 14, 2020

(54) NESTED INSULATED PACKAGING

(71) Applicant: Pratt Corrugated Holdings, Inc., Conyers, GA (US)

(72) Inventors: Yavuz Aksan, Suwanee, GA (US); Joshua David Kayne, Peachtree City, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 0 days.

(21) Appl. No.: 15/954,677

(22) Filed: Apr. 17, 2018

(65) Prior Publication Data

US 2018/0237207 A1 Aug. 23, 2018

Related U.S. Application Data

(63) Continuation of application No. 14/690,501, filed on Apr. 20, 2015, now Pat. No. 9,981,797.

(51) Int. Cl.

| | |
|---|---|
| ***B65D 81/38*** | (2006.01) |
| ***B65D 5/46*** | (2006.01) |
| ***B65B 7/20*** | (2006.01) |
| ***B65D 77/04*** | (2006.01) |
| ***B65D 5/49*** | (2006.01) |

(52) U.S. Cl.

CPC ..... *B65D 81/3862* (2013.01); *B65B 7/20* (2013.01); *B65D 5/46096* (2013.01); *B65D 5/48046* (2013.01); *B65D 77/042* (2013.01); *B65D 81/3816* (2013.01); *B65D 81/3858* (2013.01); *B65B 2230/02* (2013.01)

(58) Field of Classification Search

CPC ..... B65D 81/3825; B65D 81/3848; B65D 81/3816; B65D 5/0227; B65D 5/0254; B65D 5/4608

See application file for complete search history.

(56) References Cited

U.S. PATENT DOCUMENTS

| | | | |
|---|---|---|---|
| 265,985 | A | 10/1882 | Seabury |
| 1,701,323 | A | 2/1929 | Fredenhagen |
| 1,868,996 | A | 7/1932 | Sharp |

(Continued)

FOREIGN PATENT DOCUMENTS

| | | |
|---|---|---|
| EP | 2990196 | 3/2016 |
| FR | 3008685 | 7/2013 |

(Continued)

OTHER PUBLICATIONS

US 8,845,046 B2, 09/2014, Nomura et al. (withdrawn)

(Continued)

*Primary Examiner* — Andrew T Kirsch

(74) *Attorney, Agent, or Firm* — Taylor English Duma LLP

(57) ABSTRACT

A nested insulated packaging assembly includes: an outer box including an outer top side wall, an outer bottom side wall, and a plurality of outer lateral side walls; an inner box received in the outer box, the inner box including an inner top side wall, an inner bottom side wall, and a plurality of inner lateral side walls; a first thermal liner contacting a one of the outer lateral side walls of the outer box and a one of the inner lateral side walls of the inner box; and a second thermal liner contacting a second of the outer lateral side walls of the outer box and a second of the inner lateral side walls of the inner box.

24 Claims, 8 Drawing Sheets

(56) References Cited

U.S. PATENT DOCUMENTS 2,053,857 A 9/1936 Weiss
2,151,733 A 3/1939 Bonfield
2,386,905 A 10/1945 Meitzen
2,389,601 A 11/1945 De Witt
2,554,004 A 5/1951 Bergstein
2,899,103 A 8/1959 Ebert
2,927,720 A 3/1960 Adams
2,934,251 A 4/1960 Kramer
2,969,164 A 1/1961 Morrison
3,096,879 A 7/1963 Schumacher
3,097,782 A 7/1963 Koropatkin et al.
3,182,913 A 5/1965 Brian
3,222,843 A 12/1965 Schneider
3,552,466 A 1/1971 Fairchilds
3,734,336 A 5/1973 Rankow et al.
3,854,650 A 12/1974 Hanaue
4,030,227 A 6/1977 Oftedahl
4,049,188 A 9/1977 Persson
4,068,779 A 1/1978 Canfield
4,091,852 A 5/1978 Jordan et al.
4,294,079 A * 10/1981 Benson ..... F25D 3/125 62/372
4,399,157 A 8/1983 Caporaso
4,418,864 A 12/1983 Neilsen
4,434,890 A * 3/1984 Sieck ..... B65D 5/5038 206/443
4,444,821 A 4/1984 Young et al.
4,488,623 A 12/1984 Linnell, II et al.
4,509,645 A 4/1985 Hotta
4,650,112 A 3/1987 Booth
4,884,741 A 12/1989 Nederveld
4,953,782 A 9/1990 Noland
5,016,813 A 5/1991 Simons
5,022,582 A 6/1991 Ritter
5,062,527 A 11/1991 Westerman
5,104,035 A 4/1992 Rosenbaum, II
5,165,583 A 11/1992 Kouwenberg
5,263,339 A 11/1993 Evans
5,418,031 A 5/1995 English
5,441,170 A 8/1995 Bane, III
5,493,874 A 2/1996 Landgrebe
5,499,473 A 3/1996 Ramberg
5,596,880 A 1/1997 Welker et al.
5,996,366 A 12/1999 Renard
6,003,719 A 12/1999 Steward, III
6,164,526 A 12/2000 Dalvey
6,168,040 B1 1/2001 Sautner et al.
6,220,473 B1 4/2001 Lehman et al.
6,238,091 B1 5/2001 Mogil
6,244,458 B1 6/2001 Frysinger et al.
6,247,328 B1 6/2001 Mogil
6,325,281 B1 12/2001 Grogan
6,325,282 B1 12/2001 Kanter et al.
6,343,696 B1 2/2002 McCormick et al.
6,378,733 B1 4/2002 Boonzaier
6,453,682 B1 9/2002 Jennings et al.
6,478,268 B1 11/2002 Bidwell et al.
6,510,705 B1 1/2003 Jackson
6,582,124 B2 6/2003 Mogil
6,618,868 B2 9/2003 Minnick
6,688,133 B1 2/2004 Donefrio
6,725,783 B2 4/2004 Sekino
6,736,309 B1 5/2004 Westerman et al.
6,771,183 B2 8/2004 Hunter
6,821,019 B2 11/2004 Mogil
6,837,420 B2 1/2005 Westerman et al.
6,868,982 B2 3/2005 Gordon
6,875,486 B2 4/2005 Miller
6,899,229 B2 5/2005 Dennison et al.
6,910,582 B2 6/2005 Lantz
6,971,539 B1 12/2005 Abbe
D514,928 S 2/2006 Keberlein
7,000,962 B2 2/2006 Le
7,083,147 B2 8/2006 Movsesian et al.
7,094,192 B2 8/2006 Schoenberger et al.
D542,129 S 5/2007 Morrman
7,225,970 B2 6/2007 Philips
7,229,677 B2 6/2007 Miller
7,392,931 B2 7/2008 Issler
7,422,143 B2 9/2008 Mayer
7,452,316 B2 11/2008 Cals et al.
D582,676 S 12/2008 Rothschild
7,500,593 B2 3/2009 Mayer
7,597,209 B2 10/2009 Rothschild et al.
7,624,911 B2 12/2009 Spurrell et al.
D608,634 S 1/2010 Riedi
7,677,406 B2 3/2010 Maxson
7,681,405 B2 3/2010 Williams
7,807,773 B2 10/2010 Matsuoka et al.
7,841,512 B2 11/2010 Westerman
7,845,508 B2 12/2010 Rothschild et al.
7,870,992 B2 1/2011 Schille et al.
D651,076 S 12/2011 Van Berlo
8,101,259 B2 1/2012 Kuboniwa
8,250,882 B2 8/2012 Mustafa et al.
8,365,943 B2 2/2013 Bentley
8,424,335 B2 4/2013 Corder et al.
8,453,477 B2 6/2013 Crespo et al.
8,613,202 B2 12/2013 Williams
8,728,605 B2 5/2014 Payne et al.
8,763,423 B2 7/2014 Tattam
8,763,811 B2 7/2014 Lantz
8,763,886 B2 7/2014 Hall
8,887,515 B2 11/2014 Patstone
8,919,082 B1 * 12/2014 Cataldo ..... B65D 81/3816 220/4.29
8,938,986 B2 1/2015 Matta et al.
9,242,758 B2 1/2016 Brundage et al.
9,550,618 B1 1/2017 Jobe
9,605,382 B2 3/2017 Virtanen
9,751,683 B1 9/2017 Jobe
9,981,797 B2 5/2018 Aksan et al.
10,065,782 B1 9/2018 Jones et al.
10,065,786 B2 9/2018 Kuhn
10,106,290 B2 10/2018 Couture
D834,411 S 11/2018 Vanderhulst et al.
10,266,332 B2 4/2019 Aksan et al.
D874,268 S 2/2020 Muse et al.
2002/0050147 A1 5/2002 Mai et al.
2002/0096559 A1 7/2002 Quaintance
2004/0004111 A1 1/2004 Cardinale
2004/0016212 A1 1/2004 Miller
2004/0081727 A1 4/2004 Kelly et al.
2004/0151851 A1 8/2004 Miller
2004/0211825 A1 10/2004 Champion et al.
2005/0006446 A1 1/2005 Stafford, Jr.
2005/0159282 A1 7/2005 Schoenberger et al.
2005/0163947 A1 7/2005 Miller
2005/0178142 A1 8/2005 Perry et al.
2005/0224501 A1 10/2005 Folkert et al.
2005/0241978 A1 11/2005 Plue et al.
2006/0003057 A1 1/2006 Kelly et al.
2006/0053828 A1 3/2006 Shallman et al.
2006/0163333 A1 7/2006 Kornacki
2006/0174648 A1 8/2006 Lantz
2007/0051782 A1 3/2007 Lantz
2007/0051783 A1 3/2007 Wisecarver
2007/0152027 A1 7/2007 Hyatt et al.
2008/0078819 A1 4/2008 Strong et al.
2008/0095959 A1 4/2008 Warner et al.
2008/0099492 A1 5/2008 Mayer
2008/0289302 A1 11/2008 Vulpitta
2008/0296356 A1 12/2008 Hatcher et al.
2009/0078708 A1 3/2009 Williams
2009/0193765 A1 8/2009 Lantz
2009/0283578 A1 11/2009 Miller
2010/0072105 A1 3/2010 Glaser et al.
2010/0139878 A1 6/2010 Clemente
2010/0314397 A1 12/2010 Williams et al.
2011/0042449 A1 2/2011 Copenhaver et al.
2011/0100868 A1 5/2011 Lantz
2011/0114513 A1 5/2011 Miller
2011/0127272 A1 6/2011 Crespo et al.
2011/0241514 A1 10/2011 Nomura et al.

(56) References Cited

U.S. PATENT DOCUMENTS

| | | | | |
|---|---|---|---|---|
| 2011/0284556 | A1 | 11/2011 | Palmer et al. | |
| 2011/0311758 | A1 | 12/2011 | Burns et al. | |
| 2012/0145568 | A1 | 6/2012 | Collison et al. | |
| 2012/0248101 | A1 | 10/2012 | Tumber et al. | |
| 2012/0251818 | A1 | 10/2012 | Axrup et al. | |
| 2013/0094791 | A1 | 4/2013 | Aspenson et al. | |
| 2013/0055750 | A1 | 5/2013 | Mustafa et al. | |
| 2013/0112694 | A1 | 5/2013 | Bentley | |
| 2013/0112695 | A1* | 5/2013 | Hall | B65D 5/0227 220/592.25 |
| 2013/0140317 | A1 | 6/2013 | Roskoss | |
| 2013/0291584 | A1 | 11/2013 | Chapman, Jr. | |
| 2014/0000306 | A1 | 1/2014 | Chapman, Jr. | |
| 2014/0021208 | A1 | 1/2014 | Anti et al. | |
| 2014/0144161 | A1 | 5/2014 | Pointer et al. | |
| 2014/0151382 | A1 | 6/2014 | White et al. | |
| 2014/0319018 | A1 | 10/2014 | Collison | |
| 2014/0353317 | A1 | 12/2014 | Ranade et al. | |
| 2014/0367393 | A1 | 12/2014 | Ranade | |
| 2015/0068242 | A1 | 3/2015 | Patstone | |
| 2016/0304267 | A1 | 10/2016 | Aksan | |
| 2016/0325915 | A1 | 11/2016 | Aksan | |
| 2017/0225870 | A1 | 8/2017 | Collison | |
| 2018/0086539 | A1 | 3/2018 | Aksan et al. | |
| 2019/0185248 | A1 | 6/2019 | Aksan et al. | |
| 2019/0193917 | A1 | 6/2019 | Aksan et al. | |
| 2019/0270539 | A1 | 9/2019 | Muse et al. | |

FOREIGN PATENT DOCUMENTS

| | | | |
|---|---|---|---|
| GB | 1272730 | | 5/1972 |
| JP | 2001018952 | | 1/2001 |
| JP | 5661362 | | 1/2015 |
| WO | 2016187435 | A2 | 5/2016 |
| WO | 2016187435 | A3 | 11/2016 |

OTHER PUBLICATIONS

Aksan, Yavuz; Advisory Action for U.S. Appl. No. 14/703,094, filed May 4, 2015, dated Sep. 13, 2018, 3 pgs.
Aksan, Yavuz; Final Office Action for U.S. Appl. No. 14/703,094, filed May 4, 2015, dated Jul. 10, 2018, 25 pgs.
Aksan, Yavuz; Applicant-Initiated Interview Summary for U.S. Appl. No. 14/703,094, filed May 4, 2015, dated Jan. 16, 2019, 3 pgs.
Aksan, Yavuz; Non-Final Office Action for U.S. Appl. No. 14/703,094, filed May 4, 2015, dated Oct. 30, 2018, 13 pgs.
Aksan, Yavuz; Applicant-Initiated Interview Summary for U.S. Appl. No. 14/690,501, filed Apr. 20, 2015, dated Feb. 9, 2017, 7 pgs.
Aksan, Yavuz; Final Office Action for U.S. Appl. No. 14/690,501, filed Apr. 20, 2015, dated Dec. 8, 2016, 18 pgs.
Aksan, Yavuz; Non-Final Office Action for U.S. Appl. No. 14/690,501, filed Apr. 20, 2015, dated Aug. 17, 2016; 22 pgs.
Aksan, Yavuz; Non-Final Office Action for U.S. Appl. No. 14/690,501, filed Apr. 20, 2015, dated Aug. 8, 2017, 18 pgs.
Aksan, Yavuz; Notice of Allowability for U.S. Appl. No. 14/690,501, filed Apr. 20, 2015, dated Mar. 28, 2018, 2 pgs.
Aksan, Yavuz; Notice of Allowability for U.S. Appl. No. 14/690,501, filed Apr. 20, 2015, dated Apr. 18, 2018, 6 pgs.
Aksan, Yavuz; Notice of Allowability for U.S. Appl. No. 14/690,501, filed Apr. 20, 2015, dated Apr. 26, 2018, 6 pgs.
Aksan, Yavuz; Notice of Allowance for U.S. Appl. No. 14/690,501, filed Apr. 20, 2015, filed Jan. 31, 2018, 14 pgs.
Aksan, Yavuz; Non-Final Office Action for U.S. Appl. No. 14/703,904, filed May 4, 2015, dated Dec. 29, 2017, 39 pgs.
Aksan, Yavuz; Restriction Requirement for U.S. Appl. No. 14/703,904, filed May 4, 2015, dated Sep. 15, 2017, 7 pgs.
Greenblue; "Environmental Technical Briefs of Common Packaging Materials—Fiber-Based Materials", Sustainable Packaging Solution, 2009, 19 pgs.
MP Global Products; Article entitled: "Thermopod mailer envelopes and Thermokeeper insulated box liners", located at < http://www.mhpn.com/product/thermopod_mailer_envelopes_and_thermokeeper_insulated_box_liners/packaging>, accessed on Aug. 30, 2017, 2 pgs.
UN Packaging; Article entitled: "CooLiner® Insulated Shipping Bags", available at <http://www.chem-tran.com/packaging/supplies/cooliner-insulated-shipping-bags.php>, accessed on Aug. 30, 2017, 2 pgs.
Aksan, Yavuz; Issue Notification for U.S. Appl. No. 14/690,501, filed Apr. 20, 2015, dated May 9, 2018, 1 pg.
Aksan, Yavuz; Issue Notification for U.S. Appl. No. 14/703,094, filed May 4, 2015, dated Apr. 3, 2019, 1 pg.
Aksan, Yavuz; Notice of Allowance for U.S. Appl. No. 14/703,094, filed May 4, 2015, dated Feb. 19, 2019, 13 pgs.
Muse, John Richard; Non-Final Office Action for U.S. Appl. No. 15/909,515, filed Mar. 1, 2018, dated Mar. 18, 2019, 34 pgs.
Aksan, Yavuz; Non-Final Office Action for U.S. Appl. No. 16/280,609, filed Feb. 20, 2019, dated Jun. 13, 2019, 28 pgs.
Aksan, Yavuz; Non-Final Office Action for U.S. Appl. No. 15/809,072, filed Nov. 10, 2017, dated Aug. 6, 2019, 47 pgs.
Muse, John Richard; Ex Parte Quayle Action for U.S. Appl. No. 29/646,433, filed May 4, 2018, mailed May 14, 2019, 32 pgs.
Aksan, Yavuz; Non-Final Office Action for U.S. Appl. No. 16/293,868, filed Mar. 6, 2019, dated Feb. 10, 2020, 38 pgs.
Aksan, Yavuz; Final Office Action for U.S. Appl. No. 15/809,072, filed Nov. 10, 2017, dated Jan. 31, 2020, 22 pgs.
Muse, John Richard; Advisory Action for U.S. Appl. No. 15/909,515, filed Mar. 1, 2018, dated Nov. 20, 2019, 3 pgs.
Muse, John Richard; Non-Final Office Action for U.S. Appl. No. 15/909,515, filed Mar. 1, 2018, dated Jan. 3, 2020, 11 pgs.
Muse, John Richard; Corrected Notice of Allowance for U.S. Appl. No. 29/646,433, filed May 4, 2018, dated Dec. 9, 2019, 7 pgs.
Aksan, Yavuz; Applicant-Initiated Interview Summary for U.S. Appl. No. 16/280,609, filed Feb. 20, 2019, dated Oct. 4, 2019, 3 pgs.
Aksan, Yavuz; Final Office Action for U.S. Appl. No. 16/280,609, filed Feb. 20, 2019, dated Sep. 10, 2019, 18 pgs.
Aksan, Yavuz; Non-Final Office Action for U.S. Appl. No. 16/280,609, filed Feb. 20, 2019, dated Nov. 19, 2019, 14 pgs.
Muse, John Richard; Final Office Action for U.S. Appl. No. 15/909,515, filed Mar. 1, 2018, dated Sep. 19, 2019, 16 pgs.
Muse, John Richard; Notice of Allowance for U.S. Appl. No. 29/646,433, filed May 4, 2018, dated Sep. 26, 2019, 14 pgs.
Aksan, Yavuz; Notice of Allowance for U.S. Appl. No. 16/280,609, filed Feb. 20, 2019, dated Mar. 13, 2020, 18 pgs.
Aksan, Yavuz; Non-Final Office Action for U.S. Appl. No. 15/809,072, filed Nov. 10, 2017, dated Apr. 22, 2020, 25 pgs.
Muse, John Richard; Applicant-Initiated Interview Summary for U.S. Appl. No. 15/909,515, filed Mar. 1, 2018, dated Mar. 26, 2020, 3 pgs.
Muse, John Richard; Non-Final Office Action for U.S. Appl. No. 15/909,515, filed Mar. 1, 2018, dated Apr. 30, 2020, 16 pgs.

* cited by examiner

NESTED INSULATED PACKAGING

CROSS-REFERENCE TO RELATED APPLICATIONS

This application is a continuation of U.S. application Ser. No. 14/690,501, filed Apr. 20, 2015, which is hereby incorporated by reference herein in its entirety.

TECHNICAL FIELD

This disclosure relates to packaging. More specifically, this disclosure relates to nested insulated packaging.

BACKGROUND

Packaging perishable items, pharmaceuticals, and other temperature sensitive items poses a challenge to suppliers and consumers alike. For example, suppliers are faced with the challenge of shipping perishable items, pharmaceuticals, and other temperature sensitive items economically while minimizing spoilage, browning, bruising, over-ripening, and other forms of transit breakage. Similar challenges exist for individual consumers shipping perishable items, pharmaceuticals, and other temperature sensitive items.

SUMMARY

Disclosed is a nested insulated packaging assembly comprising an outer box including an outer top side wall, an outer bottom side wall, and a plurality of outer lateral side walls; an inner box received in the outer box, the inner box including an inner top side wall, an inner bottom side wall, and a plurality of inner lateral side walls, the plurality of inner later side walls defining a lateral outer surface and a lateral inner surface, the lateral inner surface disposed opposite from the lateral outer surface, the lateral inner surface at least partially defining an inner storage cavity within the inner box, the lateral outer surface and the lateral inner surface each comprising a first material; a first thermal liner contacting a one of the outer lateral side walls of the outer box and a one of the inner lateral side walls of the inner box, the first thermal liner contacting the lateral outer surface; and a second thermal liner contacting a second of the outer lateral side walls of the outer box and a second of the inner lateral side walls of the inner box, the second thermal liner contacting the lateral outer surface.

Also disclosed a method of assembling a nested insulated packaging comprising positioning a first thermal liner in an outer box, the outer box including an outer top side wall, an outer bottom side wall, and a plurality of outer lateral side walls, the first thermal liner contacting a one of the outer lateral side walls of the outer box; positioning a second thermal liner in the outer box, the second thermal liner contacting a second of the outer lateral side walls of the outer box; and positioning an inner box in the outer box, the inner box including an inner top side wall, an inner bottom side wall, and at least one inner lateral side wall, the first thermal liner contacting a one of the inner lateral side walls of the inner box and the second thermal liner contacting a second of the inner lateral side walls of the inner box, the at least one inner lateral side wall defining a lateral inner surface and a lateral outer surface, the lateral inner surface disposed opposite from the lateral outer surface, the lateral inner surface at least partially defining an inner storage cavity within the inner box, the lateral outer surface contacting the first thermal liner and the second thermal liner, the lateral inner surface and the lateral outer surface each comprising a first material.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is nested insulated packaging and associated methods, systems, devices, and various apparatus. The nested insulated packaging includes an outer box, an inner box, and a thermal liner. It would be understood by one of skill in the art that the disclosed nested insulated packaging is described in but a few exemplary embodiments among many. No particular terminology or description should be considered limiting on the disclosure or the scope of any claims issuing therefrom. Directional references such as "up," "down," "top," "left," "right," "front," "back," and "corners," among others are intended to refer to the orientation as shown and described in the figure (or figures) to which the components and directions are referencing.

Figure 1:
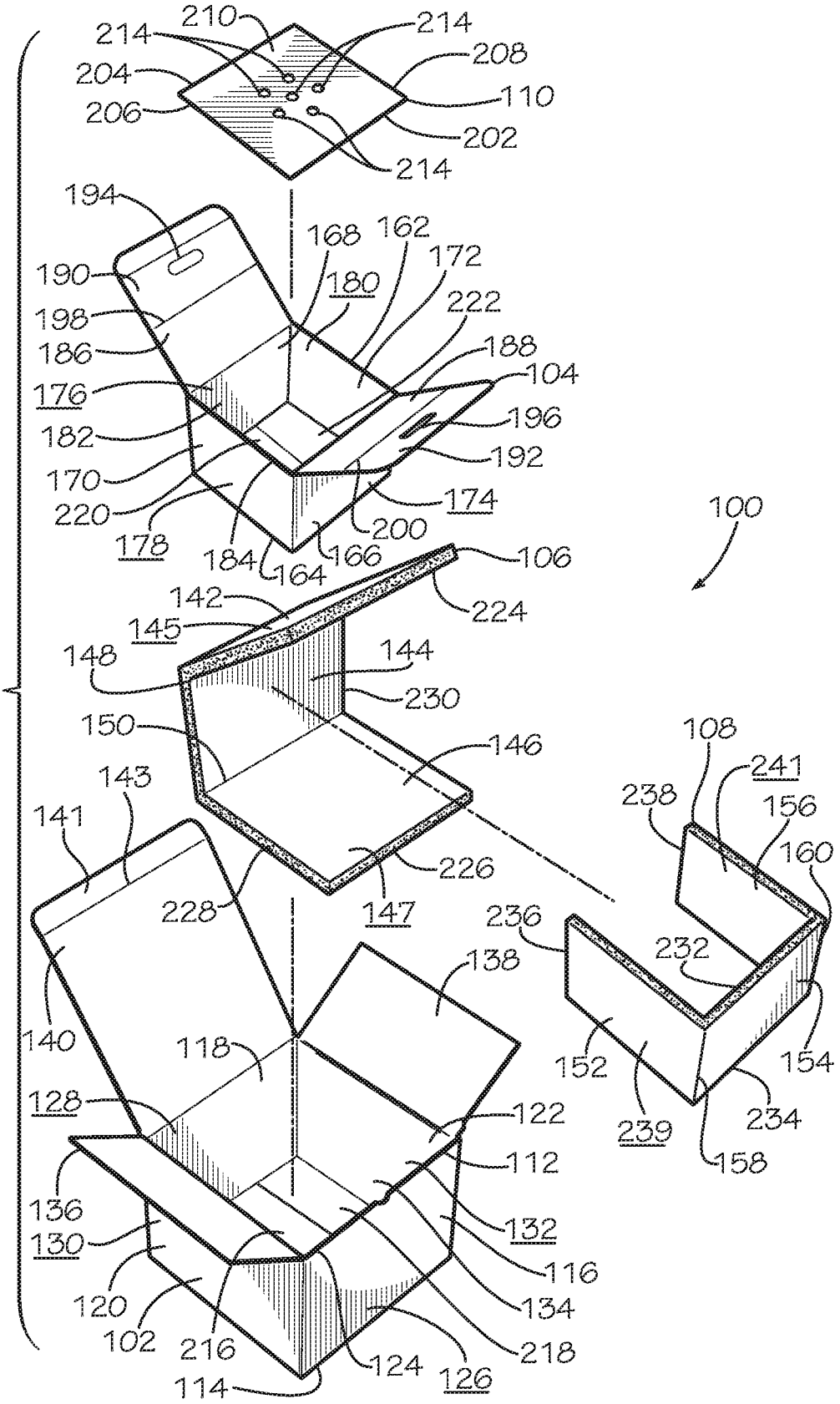
FIG. 1 is an exploded view of nested insulated packaging in accordance with one embodiment of the present disclosure including an outer box, an inner box, a first thermal liner, a second thermal liner, and a pad.

One embodiment of nested insulated packaging assembly 100 is disclosed and described in FIG. 1. The nested insulated packaging assembly 100 includes an outer box 102, an inner box 104, a first thermal liner 106, a second thermal liner 108, and a divider 110.

The outer box 102 includes a top end 112, a bottom end 114, a front lateral side wall 116, a back lateral side wall 118, a left lateral side wall 120, and a right lateral side wall 122. The front lateral side wall 116 includes an inner surface (not shown) and an outer surface 126. The back lateral side wall 118 includes an inner surface 128 and an outer surface (not shown). The left lateral side wall 120 defines an inner surface (not shown) and an outer surface 130. The right lateral side wall 122 defines an inner surface 132 and an outer surface (not shown). The inner surfaces of the lateral side walls 116,118,120,122 define an outer storage cavity 134. The lateral side walls 116,118,120,122 define a top opening 124 at the top end 112 of the outer box 102. A distance from the top end 112 to the bottom end 114 defines an outer box height.

As shown in FIG. 1, in the present embodiment, the outer box 102 includes a top left flap 136 connected to the left lateral side wall 120 and a top right flap 138 connected to the right lateral side wall 122 at the top end 112. The outer box 102 also includes a back flap 140 connected to the back lateral side wall 118 at the top end 112. When closed, the top left flap 136, top right flap 138, and back flap 140 define a top side wall of the outer box 102. In various embodiments, the back flap 140 includes a locking panel 141 connected to the back flap 140 through a bend line 143. The flaps 136,138,140 may be used to close the top opening 124. In various embodiments, the outer box 102 includes a bottom left flap 216 connected to the left lateral side wall 120 at the bottom end 114 and a bottom right flap 218 connected to the right lateral side wall 122 at the bottom end 114. When closed, the bottom flaps 216,218 define a bottom side wall of the outer box 102. The number of flaps on the outer box 102 should not be considered limiting on the current disclosure. In addition, the location, number, and shape of the flaps should not be considered limiting. For example, in various other embodiments, each lateral side wall 116,118,120,122 includes a flap at the top end 112 of the outer box 102.

In various embodiments, the outer box 102 also includes bottom flaps at each lateral side wall 116,118,120,122 at the bottom end 114. In various embodiments, any of the flaps on the outer box 102 may be integral with the outer box 102 or connected to the outer box 102. In various embodiments, any of the flaps on the outer box 102 may include connecting mechanisms such as slats, snaps, adhesive, hooks and loops, and any other connecting mechanisms for selectively holding the flaps in place when the top opening 124 is closed. In addition, the number of side walls outer box 102 should not be considered limiting on the current disclosure. In various embodiments, the outer box 102 includes the top side wall, the bottom side wall, and at least one lateral side wall. For example, in various embodiments, the outer box 102 may be a cylindrically shaped box with a plurality of side walls curved into a cylindrical shape, where each side wall is a portion of the curved cylindrical perimeter of the box, such as where each side wall is a quarter portion of the perimeter, a half portion of the perimeter, or a third portion of the perimeter, or where one side wall is a third portion of the perimeter and one side wall is a two-thirds portion of the perimeter.

The nested insulated packaging assembly 100 also includes the first thermal liner 106 in various embodiments. In various embodiments, the first thermal liner 106 includes a top end 224, a bottom end 226, a left side end 228, and a right side end 230. As shown in FIG. 1, the first thermal liner defines an outer surface 145 and an inner surface 147 between the ends 224,226,228,230. In various embodiments, the first thermal liner 106 includes a top fold 142 defined between the top end 224 and a first bend line 148, a back fold 144 defined between the first bend line 148 and a second bend line 150, and a bottom fold 146 defined between the bend line 150 and the bottom end 226. In various embodiments, the top fold 142 is foldable relative to the back fold 144 at the first bend line 148 and the bottom fold 146 is foldable relative to the back fold 144 at the second bend line 150.

The first thermal liner 106 is used to wrap the contents of the outer box 102 vertically and line the bottom flaps 216,218 at the bottom end 114 forming the bottom side of the outer box 102, the back lateral side wall 118, and the flaps 136,138,140 at the top end 112 forming the top side of the outer box 102. In various embodiments, when the first thermal liner 106 is positioned in the outer box 102, the inner surface 147 faces the contents of the outer box 102 in the outer storage cavity 134 and the outer surface 145 faces the bottom flaps 216,218 at the bottom end 114, the back lateral side wall 118, and the flaps 136,138,140 at the top end 112 of the outer box 102. In various other embodiments, the outer surface 145 may face any of the lateral side walls 116,118,120,122 as desired. A distance from the first bend line 148 to the second bend line 150 defines a height of the back fold 144. In various embodiments, the height of the back fold 144 is less than or equal to the height of the outer box 102. In various embodiments, the dimensions of the top fold 142, back fold 144, and bottom fold 146 may be varied to accommodate various outer boxes 102 having various dimensions.

In various embodiments, the nested insulated packaging assembly 100 also includes the second thermal liner 108. In various embodiments, the second thermal liner 108 includes a top side end 232, a bottom side end 234, a left side end 236 and a right side end 238. As shown in FIG. 1, the second thermal liner 108 defines an outer surface 239 and an inner surface 241 between the ends 232,234,236,238. The second thermal liner 108 includes a left fold 152 defined between the left side end 236 and a third bend line 158, a front fold 154 defined between the third bend line 158 and a fourth bend line 160, and a right fold 156 defined between the fourth bend line 160 and the right side end 238 in various embodiments. In various embodiments, the left fold 152 is foldable relative to the front fold 154 at the third bend line 158 and the right fold 156 is foldable relative to the front fold 154 at the fourth bend line 160.

The second thermal liner 108 is used to wrap the contents of the outer box horizontally and line the left lateral side wall 120, front lateral side wall 116, and right lateral side wall 122 of the outer box 102. In various embodiments when the second thermal liner 108 is positioned in the outer box 102, the inner surface 241 faces the contents in the outer storage cavity 134 of the outer box 102 and the outer surface 239 faces the left lateral side wall 120, front lateral side wall 116, and right lateral side wall 122 of the outer box 102. In various embodiments, the outer surface 239 may face any of the lateral side walls 116,118,120,122 as desired. A distance from the top end 232 to the bottom end 234 defines a height of the second thermal liner 108. In various embodiments, the height of the second thermal liner 108 is less than or equal to the height of the back fold 144 of the first thermal liner 106. In various embodiments, the dimensions of the left fold 152, front fold 154, and right fold 156 may be varied to accommodate various outer boxes 102 having various dimensions.

In various embodiments, the first thermal liner 106 and the second thermal liner 108 are C-shaped when folded. In various embodiments, the first thermal liner 106 is C-shaped by folding the top fold 142 and the bottom fold 146 in the same direction relative to the back fold 144. In various embodiments, the second thermal liner 108 is C-shaped by folding the left fold 152 and the right fold 156 in the same direction relative to the front fold 154. However, the shape of the folded liners 106,108 should not be considered limiting on the current disclosure as in various other embodiments, the folded liners 106, 108 may have any desired shape. In various embodiments, the first thermal liner 106 and the second thermal liner 108 provide both cushioning and climate control to provide cushioned protection for the contents of the outer box 102 and maintain a temperature within the outer box 102. In various embodiments, the thermal liners 106,108 may include materials including, but not limited to, polyester film, such as polyethylene terephthalate (PET) film, foams, pellets, fabrics, nonwovens, polyethylene, polyurethane, polypropylene, and various other materials that may contribute towards a cushioned and climate controlled protective layer in the nested insulated packaging assembly 100. In various embodiments, the thermal liners 106,108 are biodegradable. In various embodiments, the thermal liners 106,108 are compostable. In various embodiments, the thermal liners are R-4 polyencapsulated thermal 100% recycled cotton liners. In various embodiments, the nested insulated packaging assembly 100 includes the outer box 102, first thermal liner 106, and second thermal liner 108.

The nested insulated packaging assembly 100 also includes the inner box 104 in various embodiments; however, in various other embodiments, the inner box 104 is omitted from the nested insulated packaging assembly 100. The inner box 104 includes a top end 162, a bottom end 164, a front lateral side wall 166, a back lateral side wall 168, a left lateral side wall 170, and a right lateral side wall 172. The front lateral side wall 166 includes an inner surface (not shown) and an outer surface 174. The back lateral side wall 168 includes an inner surface 176 and an outer surface (not shown). The left lateral side wall 170 defines an inner surface (not shown) and an outer surface 178. The right lateral side wall 172 defines an inner surface 180 and an outer surface (not shown). The inner surfaces of the lateral side walls 166,168,170,172 define an inner storage cavity 182. The lateral side walls 166,168,170,172 define an inner box top opening 184 at the top end 162 of the inner box 104.

Figure 4:
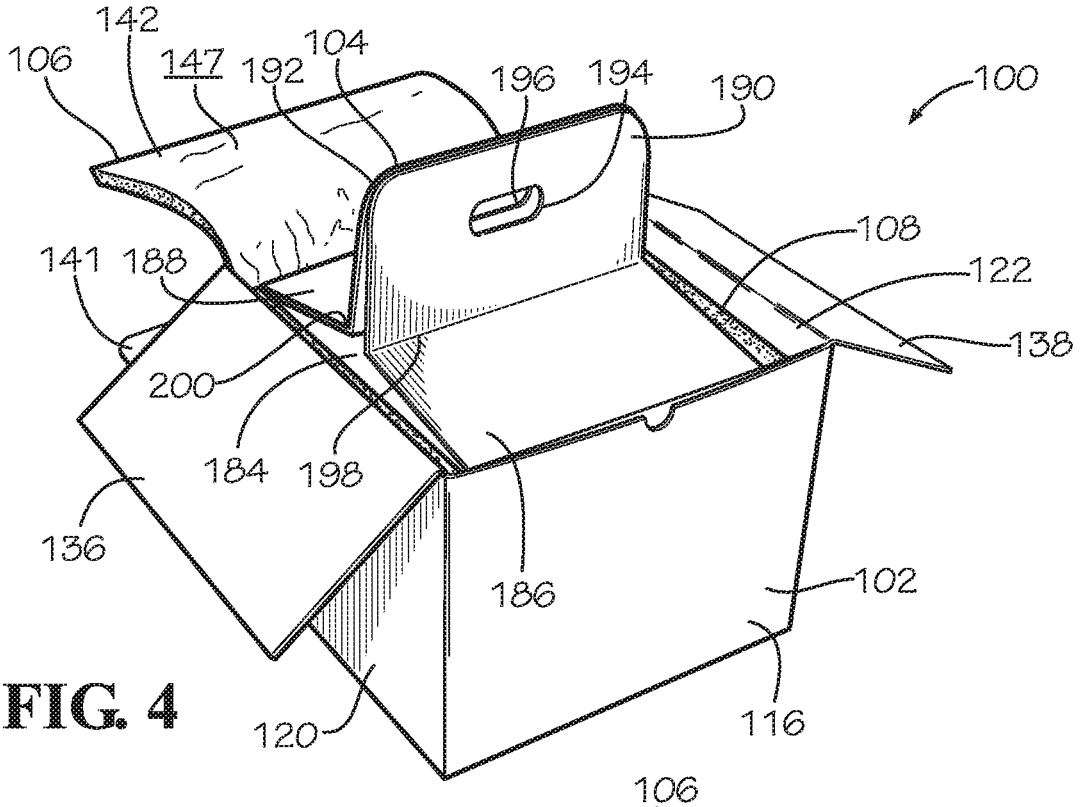
FIG. 4 is a perspective view of the nested insulated packaging of FIG. 1 showing how the inner box is positioned in the outer box with the thermal liners and with handles of the inner box projecting upwards.

As shown in FIG. 1, in the present embodiment, the inner box 104 includes a back flap 186 connected to the back lateral side wall 168 and a front flap 188 connected to the front lateral side wall 166 at the top end 162. The flaps 186,188 may be used to close the inner box top opening 184. When closed, the back flap 186 and front flap 188 define a top side wall of the inner box 104. In various embodiments, the inner box 104 includes a bottom left flap 220 at the bottom end 164 of the left lateral side wall 170 and a bottom right flap 222 at the bottom end 164 of the right lateral side wall 172. When closed, the bottom left flap 220 and bottom right flap 222 define a bottom side wall of the inner box 104. As shown in FIG. 1, in various embodiments, the back flap 186 includes a first handle panel 190 bendable along a back bend line 198 and defining a first handle 194. In various embodiments, the front flap 188 includes a second handle panel 192 bendable along a front bend line 200 and defining a second handle 196. In various embodiments, the handle panels 190,192 are folded along the respective bend lines 198,200 such that the handle panels 190,192 project upwards from the inner box 104, as shown in FIG. 4. In various embodiments, the handle panels 190,192 are in facing or near-facing contact when the handle panels 190, 192 project upwards from the inner box 104. In various embodiments, the handles 194,196 are aligned when the handle panels 190,192 project upwards from the inner box 104.

The location, shape, or number of flaps or handles with the inner box 104 should not be considered limiting on the current disclosure. For example, in various other embodiments, each lateral side wall 166,168,170,172 includes a flap at the top end 162 of the inner box 104. In various embodiments, the inner box 104 also includes bottom flaps at each lateral side wall 166,168,170,172 at the bottom end 164. In various embodiments, any of the flaps on the inner box 104 may be integral with the inner box 104 or connected to the inner box 104. In various embodiments, any of the flaps on the inner box 104 may include connecting mechanisms such as slats, snaps, adhesive, hooks and loops, and any other connecting mechanisms for selectively holding the flaps in place when the inner box top opening 184 is closed. In various embodiments, the handle panels 190,192 may be integral with the inner box 104 or connected to the inner box 104 through the flaps 186,188. In various embodiments, the handles 194,196 are formed integral with the handle panels 190,192 or connected to the handle panels 190,192 through connecting mechanisms including, but not limited to, slats, snaps, adhesive, hooks and loops, stitching, and any other connecting mechanisms. In addition, the number of side walls of the inner box 104 should not be considered limiting on the current disclosure. In various embodiments, the inner box 104 includes the top side wall, the bottom side wall, and at least one lateral side wall. For example, in various embodiments, the inner box 104 may be a cylindrically shaped box with a plurality of side walls curved into a cylindrical shape, where each side wall is a portion of the curved cylindrical perimeter of the box, such as where each side wall is a quarter portion of the perimeter, a half portion of the perimeter, or a third portion of the perimeter, or where one side wall is a third portion of the perimeter and one side wall is a two-thirds portion of the perimeter.

In various embodiments, the nested insulated packaging assembly 100 includes the divider 110; however, in various other embodiments, the divider 110 may be omitted from the nested insulated packaging assembly 100. In various embodiments, the nested insulated packaging assembly 100 includes the outer box 102, first thermal liner 106, second thermal liner 108, and divider 110. The divider 110 includes a front side 202, a back side 204, a left side 206, a right side 208, a top side 210, and a bottom side (not shown). In various embodiments, the sides 202,204,206,208 define a divider shape such that the divider 110 is insertable into the inner storage cavity 182 of the inner box 104. As shown in FIG. 1, in various embodiments, the divider 110 includes at least one vent opening 214 through the divider 110. In the present embodiment, the divider 110 includes six vent openings 214 centrally positioned on the divider 110; however, the number, shape, or location of vent openings 214 on the divider 110 should not be considered limiting on the current disclosure. In various embodiments, the vent opening 214 enables and regulates fluid flow through the divider 110. In various other embodiments, the divider 110 may include various other mechanisms for enabling and regulating fluid flow through the divider 110 such as various perforations, slits, slots, or various other similar mechanisms. In various embodiments, the divider 110 may not have any vent openings 214 or otherwise prevent fluid flow through the divider 110.

In various embodiments, the divider 110 may include an anchoring mechanism for securing a refrigerant on the divider 110 in the upper chamber 700, the lower chamber 702, or in both chambers 700,702. In various embodiments, the anchoring mechanism may be a strap, panels, slat, hook and loop connectors, adhesives, or various other anchoring mechanisms for securing a refrigerant on the divider 110.

Figure 2:
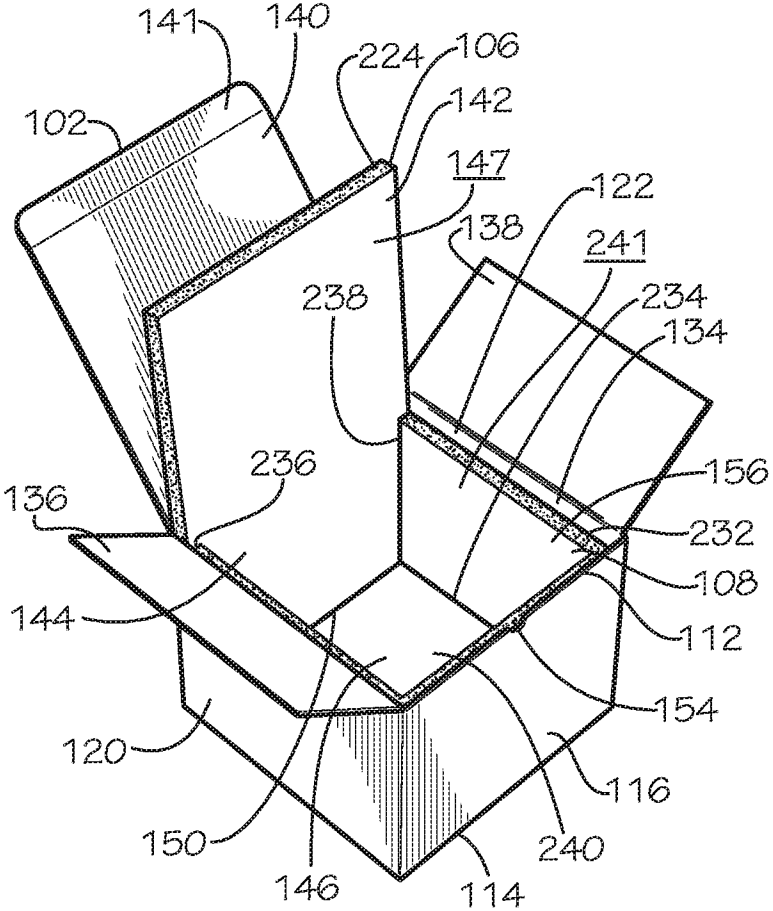
FIG. 2 is a perspective view of the first thermal liner, second thermal liner, and outer box of FIG. 1 with the first thermal liner and second thermal liner positioned in the outer box.
Figure 7:
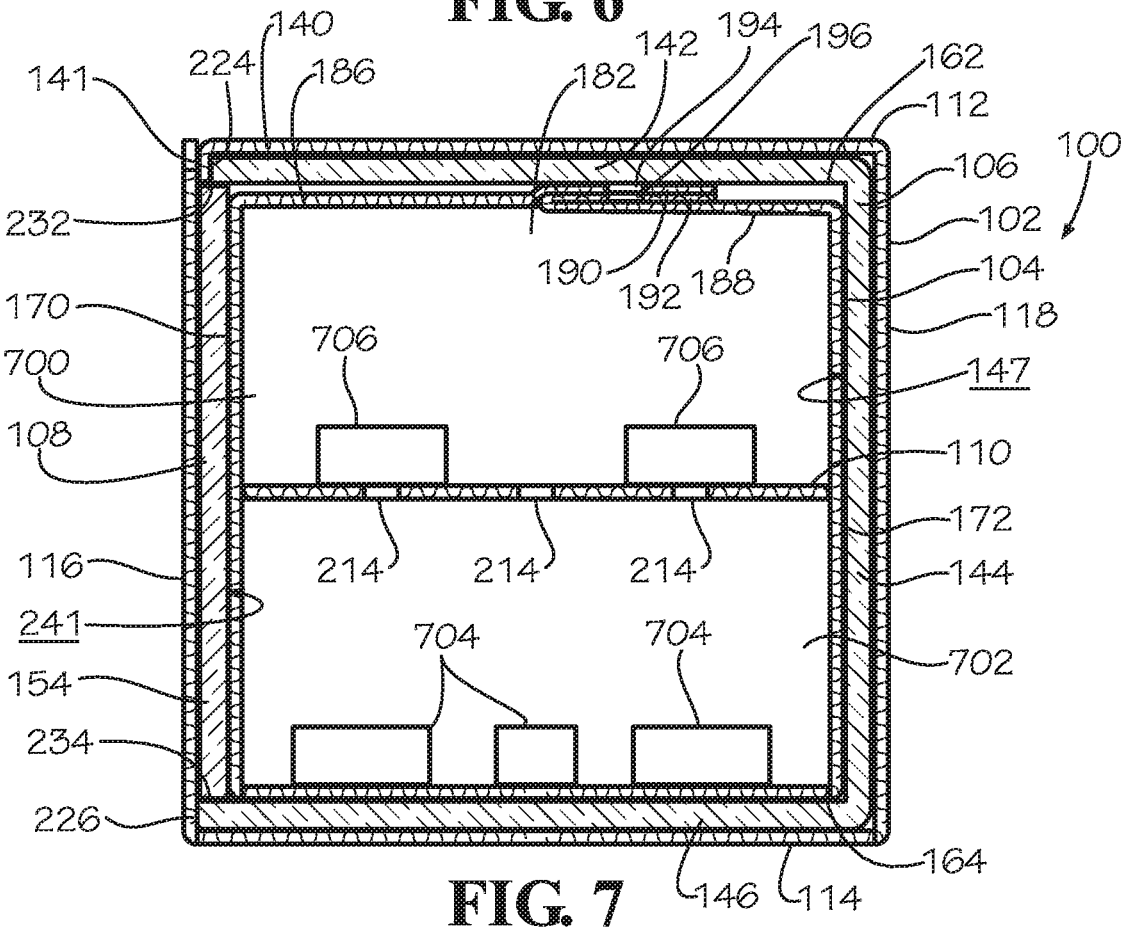
FIG. 7 is a sectional view of the nested insulated packaging of FIG. 6 taken along line 7-7 in FIG. 6.

FIG. 2 shows the outer box 102 with the first thermal liner 106 and second thermal liner 108 positioned in the outer storage cavity 134 of the outer box 102. As shown in FIG. 2, the first thermal liner 106 lines the bottom flaps at the bottom end 114 and the back lateral side wall 118 of the outer box 102 and the second thermal liner 108 lines the left lateral side wall 120, front lateral side wall 116, and right lateral side wall 122 of the outer box 102. In various embodiments, as shown in FIG. 7, the second thermal liner 108 is positioned in the outer box 102 with the first thermal liner 106 such that the bottom end 234 of the second thermal liner 108 contacts the inner surface 147 of the first thermal liner 106 on the bottom fold 146 of the first thermal liner 106 and the left side end 236 and the right side end 238 of the second thermal liner 108 contact the inner surface 147 of the first thermal liner 106 on the back fold 144 of the first thermal liner 106. When the nested insulated packaging assembly 100 is closed, as shown in FIG. 7, the top end 232 of the second thermal liner 108 contacts the inner surface 147 of the first thermal liner 106 on the top fold 142 of the first thermal liner 106. When the box 102 is closed, the first thermal liner 106 also lines the back flap 140 at the top end 112 of the outer box 102. As shown in FIG. 2, the height of the outer box 102 is greater than or equal to the height of the back fold 144 of the first thermal liner 106 and the height of the back fold 144 of the first thermal liner 106 is greater than or equal to the height of the second thermal liner 108. In various embodiments, an insulated cavity 240 is defined by the first thermal liner 106 and second thermal liner 108 lining the outer box 102. The insulated cavity 240 is cushioned and maintains a temperature within the outer box 102.

Figure 3:
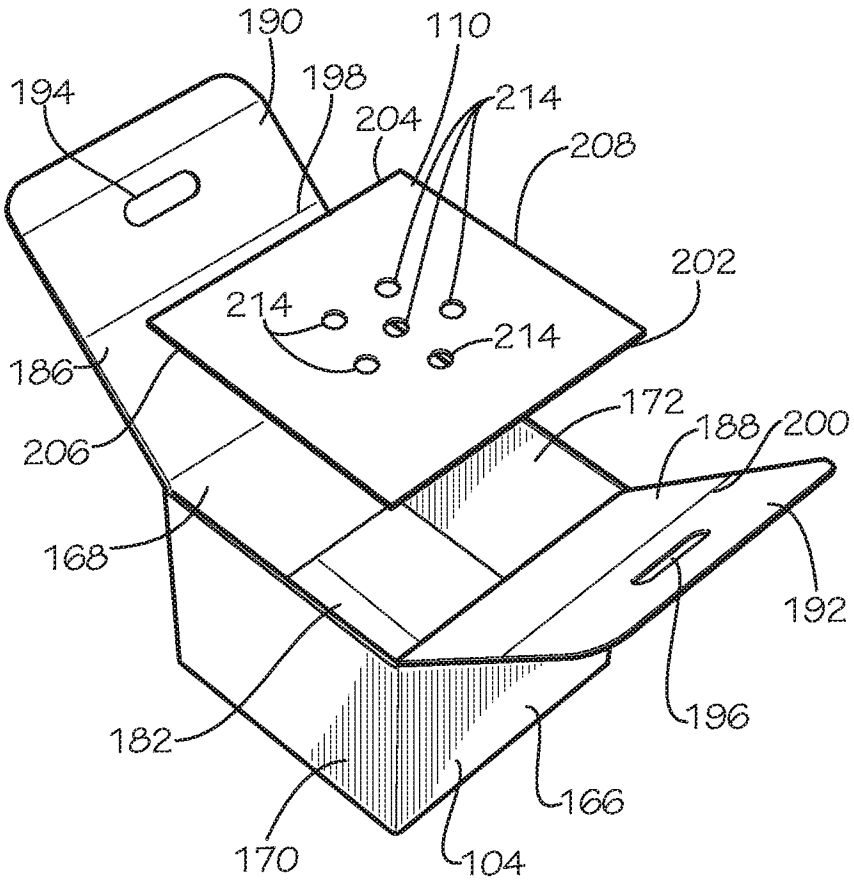
FIG. 3 is an exploded view of the inner box and pad of FIG. 1.

FIG. 3 shows the inner box 104 and divider 110. As shown in FIG. 3, the sides 202,204,206,208 define a shape of the divider 110 such that the divider 110 is insertable into the inner storage cavity 182 of the inner box 104 in the horizontal orientation shown in FIG. 3 and the divider 110 is housed within the inner box 104.

FIG. 4 shows the inner box 104 inserted into the insulated cavity 240 formed by the first thermal liner 106 and the second thermal liner 108 when the liners 106,108 are positioned in the outer box 102. In various embodiments, the inner box 104 is inserted into the insulated cavity 240 such that the front lateral side wall 166 is aligned with the front lateral side wall 116 of the outer box 102, the back lateral side wall 168 is aligned with the back lateral side wall 118 of the outer box 102, the left lateral side wall 170 is aligned with the left lateral side wall 120 of the outer box 102, and the right lateral side wall 172 is aligned with the right lateral side wall 122 of the outer box 102; however, this alignment should not be considered limiting on the current disclosure as in various other embodiments, the lateral side walls 166,168,170,172 may have any desired alignment relative to the lateral side walls 116,118,120,122 of the outer box 102. When the inner box 104 is positioned in the insulated cavity 240, one outer surface is in contact with the inner surface 147 of the first thermal liner 106 on the back fold 144 of the first thermal liner 106 and the remaining outer surfaces of the side walls 166,168,170,172 of the inner box 104 are in contact with the inner surface 241 of the second thermal liner 108. In various embodiments, the inner surface 147 of the first thermal liner 106 and the inner surface 241 of the second thermal liner 108 are in contact with the inner box 104 and the outer surface 145 of the first thermal liner 106 and the outer surface 239 of the second thermal liner 108 are in contact with the outer box 102.

As shown in FIG. 4, in various embodiments, the first handle panel 190 is bent along the back bend line 198 such that the first handle panel 190 projects upwards from the inner box 104. In various embodiments, the second handle panel 192 is bent along the front bend line 200 such that the second handle panel 192 projects upwards from the inner box 104. In various embodiments, both handle panels 190, 192 are bent along bend lines 198,200 and project upwards from the inner box 104. When both handle panels 190,192 project upwards, in various embodiments, the first handle 194 may align with the second handle 196. In various embodiments, the handle panels 190,192 projecting upwards enable a user to more easily grab the inner box 104 through the first handle 194, second handle 196, or both handles 194,196 and remove the inner box 104 from the insulated cavity 240.

Figure 5:
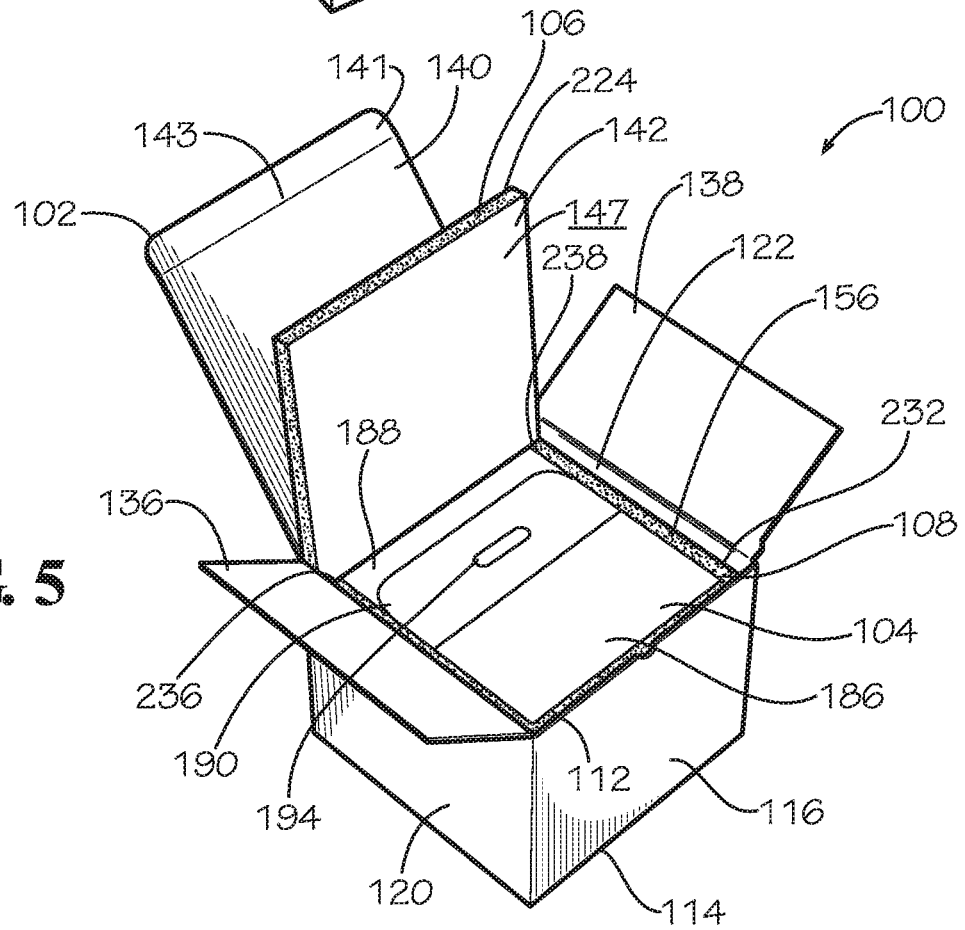
FIG. 5 is a perspective view of the nested insulated packaging of FIG. 1 with handles of the inner box folded so the outer box may be closed.

FIG. 5 shows the inner box 104 inserted into the insulated cavity 240 with the handle panels 190,192 in a collapsed position which blocks the inner box top opening 184. As partially shown in FIG. 5, in various embodiments, in the collapsed position, the back flap 186 and first handle panel 190 are folded over the front flap 188 and second handle panel 192 such that the back flap 186, first handle panel 190, front flap 188, and second handle panel 192 are orthogonal to the lateral side walls 116,118,120,122 of the outer box 102. In various other embodiments, the flaps 186,188 and handle panels 190,192 may be folded at an angle other than orthogonal. In various other embodiments, the front flap 188 and second handle panel 192 may be folded over the back flap 186 and first handle panel 190. In various other embodiments, the flaps 186,188 and/or panels 190,192 may be folded in any configuration suitable to block the inner box top opening 184.

Figure 6:
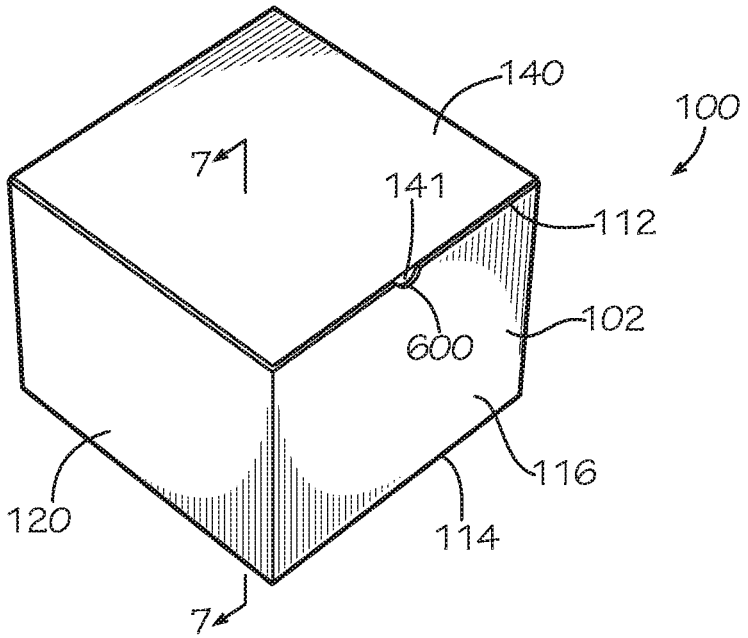
FIG. 6 is a perspective view of the nested insulated packaging of FIG. 1 with the outer box closed.

FIG. 6 shows the nested insulated packaging assembly 100 fully closed. When the nested insulated packaging assembly 100 is fully closed, the back flap 140 is folded to cover the top opening 124 of the outer storage cavity 134. In various embodiments, the locking panel 141 is inserted into the outer storage cavity 134 to help secure the back flap 140 closed. The fully closed nested insulated packaging assembly 100 may be self-sealing in various embodiments. In various other embodiments, the nested insulated packaging assembly 100 may utilize sealers such as various adhesives, glues, tapes, hook and loop connectors, and various other connecting mechanisms. As shown in FIG. 6, in various embodiments, a notch 600 is defined in the front lateral side wall 116 at the top end 112. In various embodiments, the notch 600 enables a user to access the locking panel 141.

In the current embodiment, the first thermal liner 106 contacts the outer box 102 at the bottom side wall of the outer box 102 formed by flaps 216,218, the back lateral side wall 118, and the top side wall of the outer box 102 formed by flaps 136,138,140. In the current embodiment, the first thermal liner 106 also contacts the inner box 104 at the bottom side wall of the inner box 104 formed by flaps 220,222, the back lateral side wall 168, and the top side wall of the inner box formed by flaps 186,188. In the current embodiment, the second thermal liner 108 contacts the outer box 102 at the left lateral side wall 120, front lateral side wall 116, and right lateral side wall 122. In the current embodiment, the second thermal liner 108 also contacts the inner box 104 at the left lateral side wall 170, the front lateral side wall 166, and the right lateral side wall 172. In various other embodiments, the liners 106,108 may have any desired configuration such that together, the liners 106,108 contact the respective side walls of the outer box 102 and inner box 104. The respective contact between the first thermal liner 106, second thermal liner 108, outer box 102, and inner box 104 is partially shown in FIG. 7.

FIG. 7 shows a cross-sectional view of the nested insulated packaging assembly 100 taken along line 7-7 in FIG. 6. As shown in FIG. 7, when the nested insulated packaging assembly 100 is fully closed, the locking panel 141 connected to the back flap 140 is at least partially inserted into the outer storage cavity 134 such that the locking panel 141 is adjacent to the front lateral side wall 116. FIG. 7 also shows the back flap 186 and first handle panel 190 folded over the front flap 188 and second handle panel 192 such that the back flap 186, first handle panel 190, front flap 188, and second handle panel 192 are orthogonal to the side walls 170,172 of the inner box 104 in various embodiments.

In various embodiments, a user may desire to package items 704 at a first temperature in the nested insulated packaging assembly 100 and items 706 at a second temperature in the nested insulated packaging assembly 100. In various embodiments, the items 704 and items 706 may be various perishable items, pharmaceuticals, other temperature sensitive items, or other items to be shipped such as boxes of food, bottles of beverages, bagged fruits, bagged vegetables, and various other items. As shown in FIG. 7, the divider 110 is positioned in the inner storage cavity 182 of the inner box 104. The divider 110 divides the inner storage cavity 182 into an upper chamber 700 and a lower chamber 702. In various embodiments, the divider 110 may be mounted in the inner box 104 through various connecting mechanisms such as adhesives and glues, positioned on a ledge or flap of the inner surface of the inner box 104, rest on top of the items 704 in the lower chamber, or otherwise be positioned in the inner storage cavity 182 dividing the inner storage cavity into the upper chamber 700 and lower chamber 702.

In various embodiments, a combination of the first thermal liner 106, second thermal liner 108, and divider 110 maintain the lower chamber 702 at a first temperature suitable for the items 704 and maintain the upper chamber 700 at a second temperature suitable for the items 706. In various embodiments, the upper chamber 700 is maintained at a temperature above the temperature of the lower chamber 702. As described above, in various embodiments, the divider 110 includes vent openings 214 enabling fluid flow, typically air flow in various embodiments, through the divider 110. In various embodiments, warm air present in the lower chamber 702 may be vented to the upper chamber 700 through the vent openings 214. Venting of the warm air to the upper chamber 700 may keep the lower chamber 702 at a colder temperature for a longer duration because the divider 110 isolates the two temperature chambers. In this manner, co-shipment of items requiring dual temperatures is enabled.

Each of the upper chamber 700 and the lower chamber 702 may have customized temperature profiles. In various embodiments, the size, shape, and number of vent openings 214 may regulate the air flow through the divider 110 at desired levels to achieve specific temperature profiles in each of the upper chamber 700 and the lower chamber 702. In various embodiments, the insulation properties of the first thermal liner 106, second thermal liner 108, outer box 102, inner box 104, and divider 110 are also utilized to achieve specific temperature profiles in each of the upper chamber 700 and the lower chamber 702. As shown in FIG. 7, in various embodiments, the inner box 104 provides a physical barrier between the items 704,706 to be shipped and the thermal liners 106,108. In these embodiments, the thermal liners 106,108 may not contact the items 704,706 and the wear on the thermal liners 106,108 from the items 704,706, such as tearing, moisture, dirt, and other types of wear, is reduced.

The temperature profiles in each of the upper chamber 700 and lower chamber 702 may be controlled through location of a refrigerant in the outer box 102, location of a refrigerant in the inner box 104, the vent openings 214, the composition of the divider 110, the shape of the divider 110, and the insulation properties of the first thermal liner 106, second thermal liner 108, outer box 102, inner box 104, and divider 110. In various embodiments, the refrigerant may be selected from the group including, but not limited to, ice packs, dry ice, gel packs, chilling units, water, and various other mechanisms for keeping items chilled. In various embodiments, these aspects of the nested insulated packaging assembly 100 may be varied to obtain desired temperature profiles in each of the upper chamber 700 and lower chamber 702.

Figure 8:
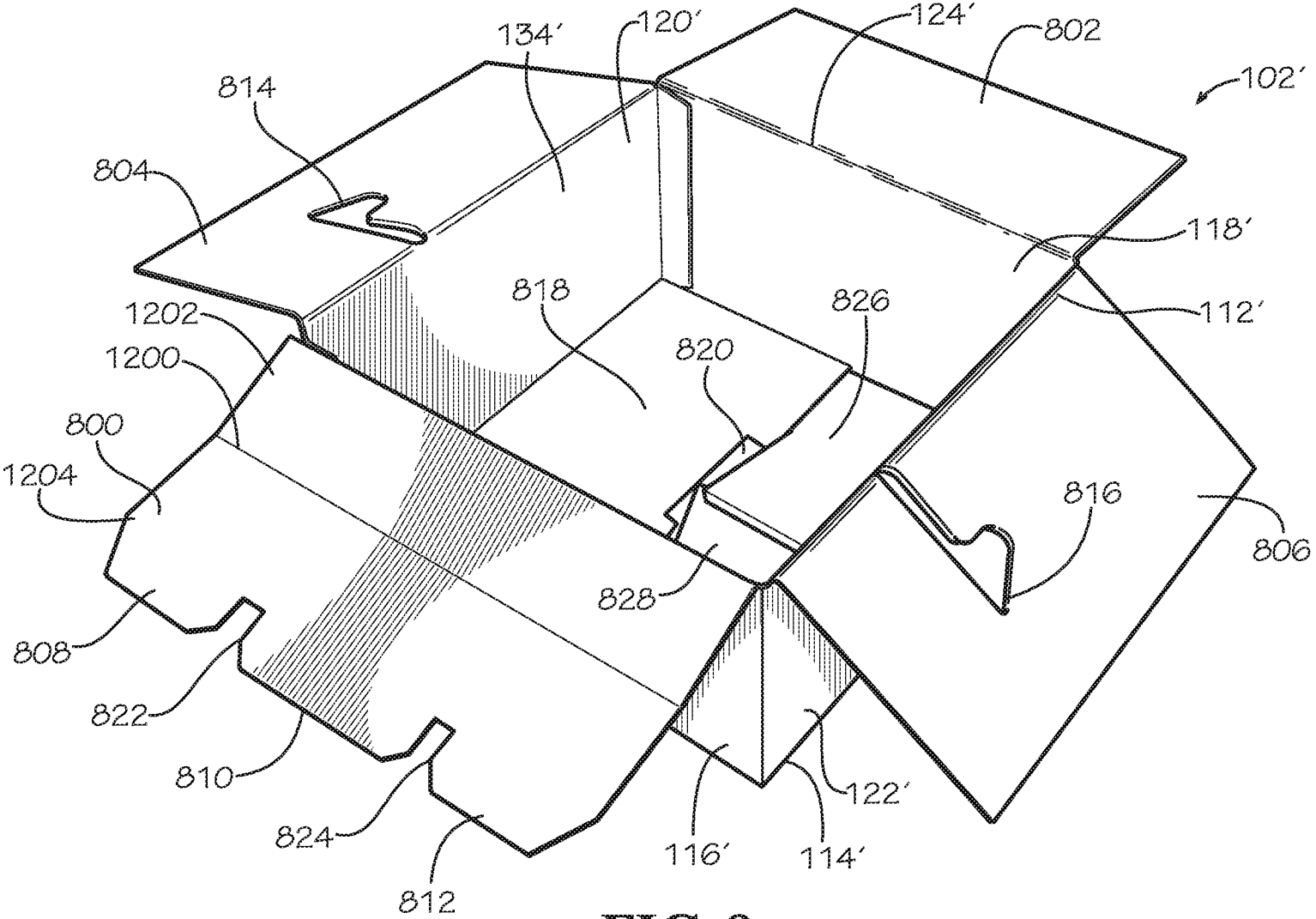
FIG. 8 is a perspective view of another embodiment of an outer box.

FIG. 8 shows another embodiment of an outer box 102'. In various embodiments, the outer box 102' is similar to the outer box 102 and includes a top end 112', a bottom end 114', a front lateral side wall 116', a back lateral side wall 118', a left lateral side wall 120', and a right lateral side wall 122'. The lateral side walls 116',118',120',122' define a top opening 124' at the top end 112' of the outer box 102'. In various embodiments, the top opening 124' provides access to an outer storage cavity 134' defined by the outer box 102'.

As shown in FIG. 8, the outer box 102' includes a front locking flap 800 at the top end 112' of the front lateral side wall 116', a back locking flap 802 at the top end 112' of the outer box 102' at the back lateral side wall 118', a left locking flap 804 at the top end 112' of the outer box 102' at the left lateral side wall 120', and a right locking flap 806 at the top end 112' of the outer box 102' at the right lateral side wall 120'. In various embodiments, a bend line 1200 may separate the front locking flap 800 into a base panel 1202 and a locking panel 1204. When closed, the locking flaps 800,802, 804,806 define a top side wall of the outer box 102'. In various embodiments, the outer box 102' also includes a front bottom locking flap 828 at the bottom end 114' of the outer box 102' at the front lateral side wall 116', a back bottom locking flap 826 at the bottom end 114' of the outer box 102' at the back lateral side wall 118', a left bottom locking flap 818 at the bottom end 114' of the outer box 102' at the left lateral side wall 120', and a right bottom locking flap 820 at the bottom end 114' of the outer box 102' at the right lateral side wall 120'. When closed, the locking flaps 818,820,826,828 define a bottom side wall of the outer box 102'. The number, shape, or location of locking flaps on the outer box 102' should not be considered limiting on the current disclosure as in various embodiments, the outer box 102' may have any desired number, shape, or location of locking flaps.

As shown in FIG. 8, in various embodiments, the locking flaps 800,802,804,806 of the outer box 102' in combination form a self-sealing mechanism. In various embodiments, the self-sealing mechanism enables the outer box 102' to be closed and secured without additional sealing mechanisms such as tapes, glues, adhesives, and various other similar mechanisms. In various embodiments, the self-sealing mechanism includes a left locking tab 808, a center locking tab 810, and a right locking tab 812 defined on the front locking flap 800. As shown in FIG. 8, in various embodiments the self-sealing mechanism also includes a first locking slot 822 on the front locking flap 800 between the left locking tab 808 and the center locking tab 810. In various embodiments, the self-sealing mechanism also includes a second locking slot 824 defined on the front locking flap 800 between the center locking tab 810 and the right locking tab 812. Although a self-sealing mechanism with three locking tabs 808,810,812 and two locking slots 822,824 on the front locking flap 800 is shown in the current embodiment, the number of locking tabs or locking slots on the front locking flap 800 should not be considered limiting on the current embodiment. As shown in FIG. 8, in various embodiments, self-sealing mechanism also includes a left flap locking slot 814 defined on the left top locking flap 804 and a right flap locking slot 816 defined on the right top locking flap 806. In various embodiments, the flap locking slots 814,816 are L-shaped; however, the shape of the flap locking slots 814,816 should not be considered limiting on the current disclosure as in various other embodiments, the flap locking slots 814,816 may have any desired shape. The number of locking slots on the left locking flap 804 or right locking flap 806 should also not be considered limiting on the current disclosure.

Figure 9:
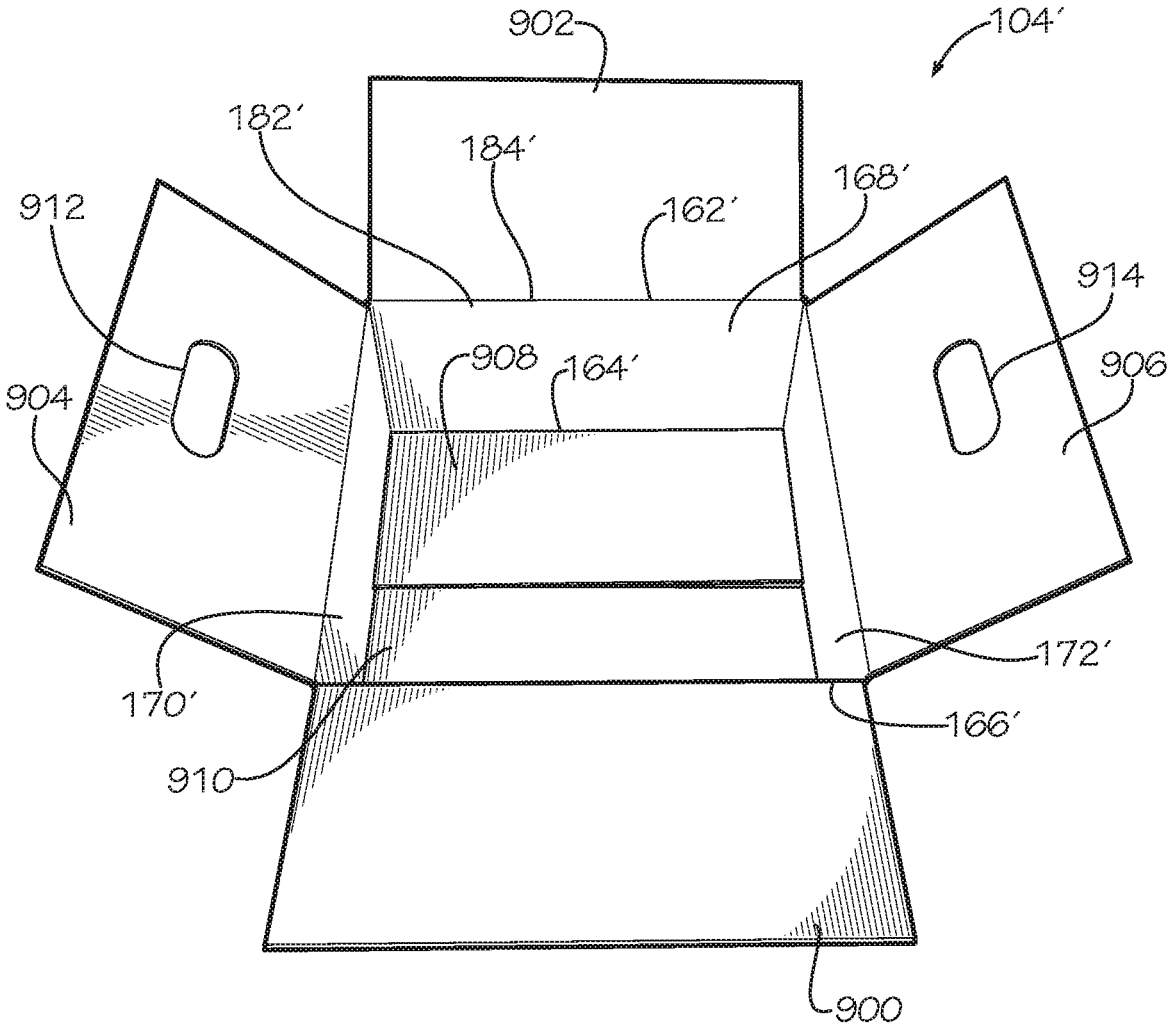
FIG. 9 is a perspective view of another embodiment of an inner box.

FIG. 9 shows another embodiment of an inner box 104'. In various embodiments, the inner box 104' is similar to inner box 104 and includes a top end 162', a bottom end 164', a front lateral side wall 166', a back lateral side wall 168', a left lateral side wall 170', and a right lateral side wall 172'. The inner surfaces of the lateral side walls 166',168',170', 172' define an inner storage cavity 182'. The lateral side walls 166',168',170',172' define an inner box top opening 184' at the top end 162' of the inner box 104'.

As shown in FIG. 9, the inner box 104' includes a front flap 900 connected to the front lateral side wall 166' at the top end 162', a back flap 902 connected to the back lateral side wall 168' at the top end 162', a left flap 904 connected to the left lateral side wall 170' at the top end 162', and a right flap 906 connected to the right lateral side wall 172' at the top end 162'. When closed, the flaps 900,902,904,906 define a top side wall of the inner box 104'. In various embodiments, the inner box 104' also includes a back bottom flap 908 connected to the back lateral side wall 168' at the bottom end 164' and a front bottom flap 910 connected to the front lateral side wall 166' at the bottom end 164'. When closed, the flaps 908,910 define a bottom side wall of the inner box 104'. The shape, location, or number of flaps should not be considered limiting on the current disclosure.

As shown in FIG. 9, in various embodiments, the left flap 904 defines a left handle opening 912 and the right flap 906 defines a right handle opening 914. In various embodiments, a user may grab the left handle opening 912, right handle opening 914, or both handle openings 912,914 to aid in handling the inner box 104'. The location, shape, and number of handle openings should not be considered limiting on the current embodiment as in various other embodiments, a handle opening may be defined in any of the flaps 900,902, 904,906 or none of the flaps 900,902,904,906.

Figure 10:
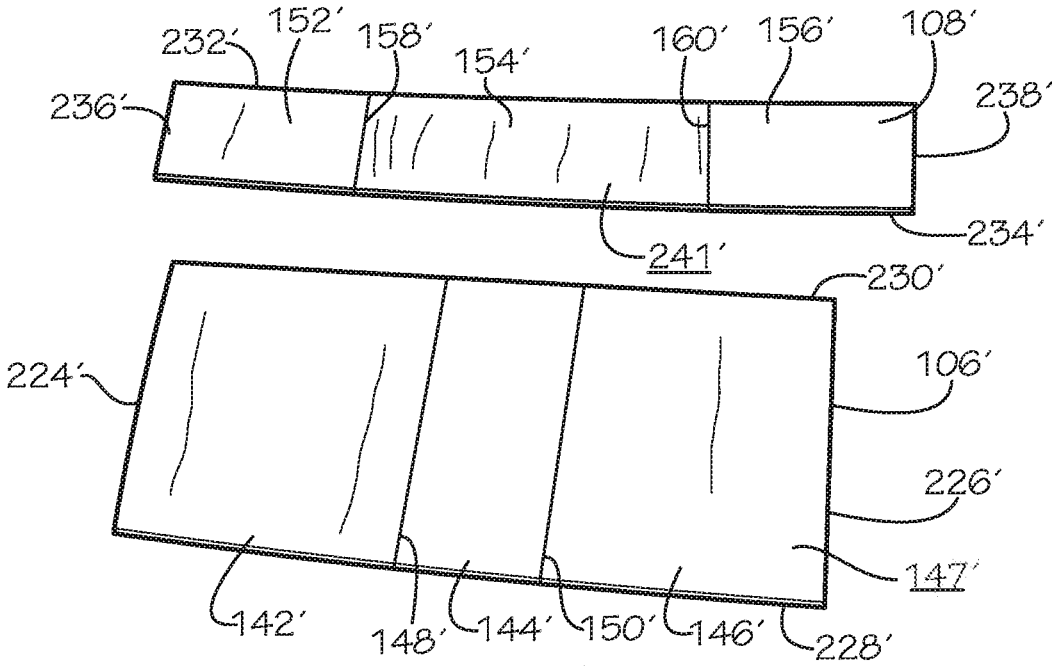
FIG. 10 is a top view of another embodiment of the first thermal liner and the second thermal liner.

FIG. 10 shows another embodiment of a first thermal liner 106' and a second thermal liner 108'. In various embodiments, the first thermal liner 106' is similar to the first thermal liner 106 and includes a top end 224', a bottom end 226', a left side end 228', and a right side end 230'. As shown in FIG. 10, the first thermal liner 106' defines an inner surface 147' and an outer surface (not shown) between the ends 224',226',228',230'. In various embodiments, the first thermal liner 106' includes a top fold 142' defined between the top end 224' and a first bend line 148', a back fold 144' defined between the first bend line 148' and a second bend line 150', and a bottom fold 146' defined between the bend line 150' and the bottom end 226'. In various embodiments, the second thermal liner 108' is similar to the second thermal liner 108 and includes a top side end 232', a bottom side end 234', a left side end 236', and a right side end 238'. As shown in FIG. 10, the second thermal liner 108' defines an inner surface 241' and an outer surface (not shown) between the ends 232',234',236',238'. The second thermal liner 108' includes a left fold 152' defined between the left side end 236' and a third bend line 158', a front fold 154' defined between the third bend line 158' and a fourth bend line 160', and a right fold 156' defined between the fourth bend line 160' and the right side end 238' in various embodiments.

As shown in FIG. 10, in various embodiments, a distance from the first bend line 148' to the second bend line 150' on the first thermal liner 106', which is the height of the back fold 144', is greater than a distance from the bottom side end 234' to the top side end 232' of the second thermal liner 108', which is the height of the second thermal liner 108'.

Figure 11:
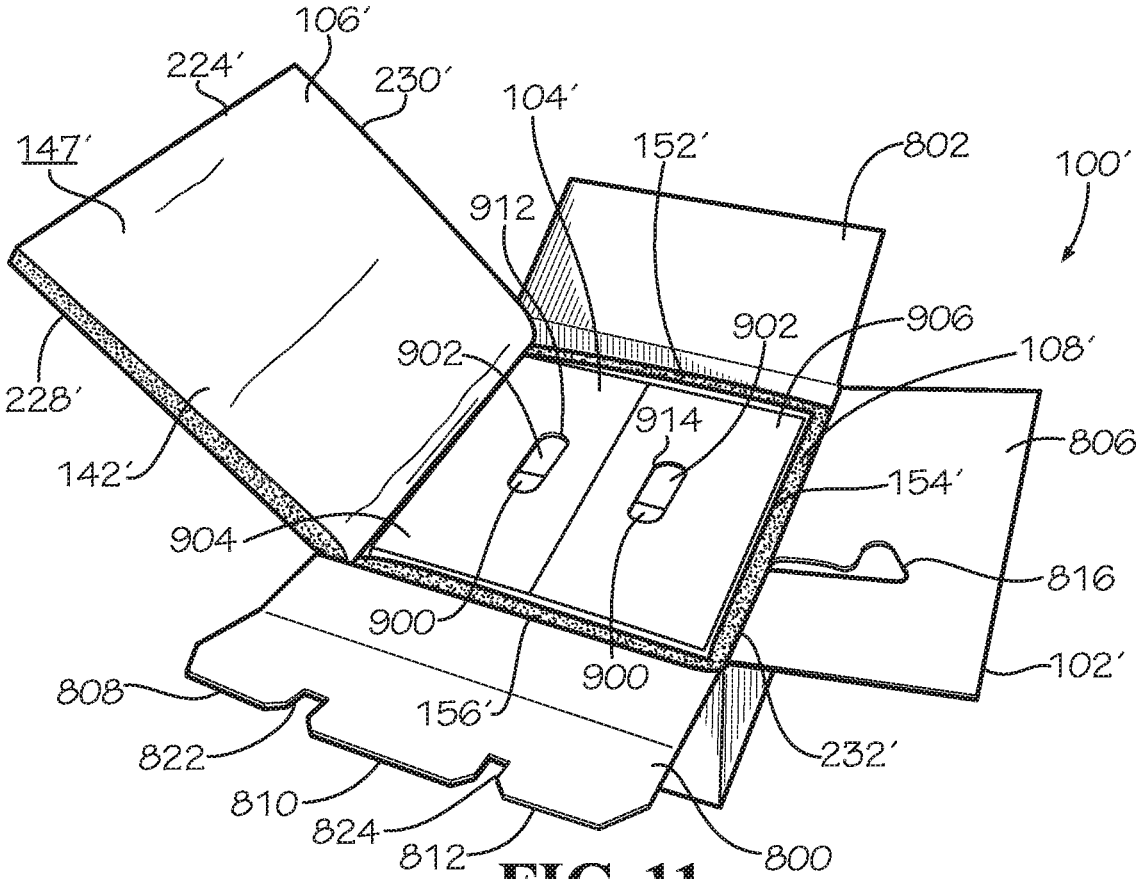
FIG. 11 is a perspective view of the outer box of FIG. 10, the inner box of FIG. 9, and the thermal liners of FIG. 10 showing how the thermal liners and inner box are positioned in the outer box.
Figure 12:
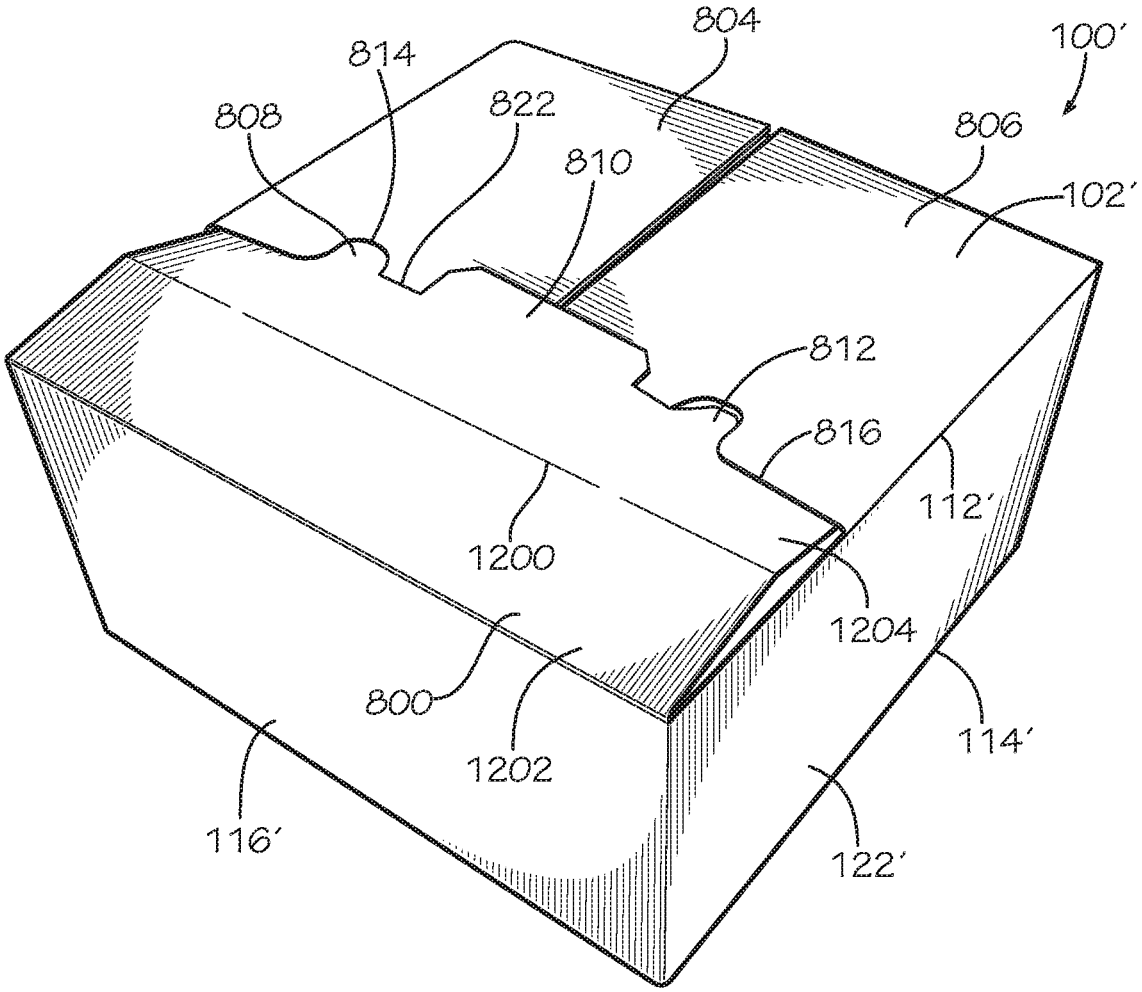
FIG. 12 is a perspective view of the outer box of FIG. 10 in a closed position.

FIG. 11 shows another embodiment of nested insulated packaging assembly 100' with the thermal liners 106',108' shown in in FIG. 10 and the inner box 104' shown in FIG. 9 inserted into the outer box 102' shown in FIG. 8. FIG. 12 shows the nested insulated packaging assembly 100' with the outer box 102' closed and the locking flaps 800,804,806 engaged. In various embodiments, the self-sealing mechanism, including locking flaps 800,804,806, enable the nested insulated packaging assembly 100' to be self-sealing and secure the nested insulated packaging assembly 100' closed.

As shown in FIG. 12, in various embodiments the self-sealing mechanism includes the bend line 1200 defined on the front locking flap 800. The bend line 1200 may separate the front locking flap 800 into the base panel 1202 and the locking panel 1204. In various embodiments, the locking panel 1204 is bent relative to the base panel 1202 along bend line 1200. In various embodiments, the bending of the locking panel 1204 permits the left locking tab 808 of the front locking flap 800 to be inserted into the left locking slot 814 of the left flap 804. The bending also permits the right locking tab 812 of the front locking flap 800 to be inserted into the right locking slot 816 of the right flap 806. As shown in FIG. 12, in various embodiments, the center locking tab 810 is positioned over the flaps 804,806 when the left locking tab 808 is inserted into the left locking slot 814 and the right locking tab 812 is inserted into the right locking slot 816. In this manner, the tabs 808,810,812 lock the front locking flap 800 with the side flaps 804,806 and lock the nested insulated packaging assembly 100'. In various embodiments, the center tab 810 holds the side flaps 804,806 down and the left tab 808 and right tab 812 hold the front locking flap 800 down.

A method of assembling the nested insulated packaging assembly 100 is also disclosed. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. The outer box 102 having the outer storage cavity 134 is provided.

The first thermal liner 106 is positioned in outer storage cavity 134 of the outer box 102 such that the bottom fold 146 contacts a bottom side of the box, the back fold 144 contacts one of the lateral side walls, such as the back lateral side wall 118, of the outer box 102, and the top fold 142 contacts a top side of the outer box 102 when closed such that the top fold 142 covers the top opening 124 of the outer storage cavity 134. The second thermal liner 108 is positioned in the outer storage cavity 134 of the outer box 102 such that the second thermal liner 108 contacts three of the lateral side walls of the outer box 102, such as the left lateral side wall 120, right lateral side wall 122, and front lateral side wall 116. The second thermal liner 108 is positioned in various embodiments such that the bottom end 234 contacts and rests on the inner surface 147 of the first thermal liner 106 on the bottom fold 146 of the first thermal liner 106, the left side end 236 and right side end 238 contacts the inner surface 147 of the first thermal liner 106 on the back fold 144 of the first thermal liner 106, and the top end 234 contacts the inner surface 147 of the first thermal liner 106 on the top fold 142 when the top fold 142 is closed.

The first thermal liner 106 and second thermal liner 108 positioned in the outer storage cavity 134 define the insulated cavity 240. In various embodiments, the inner surface 147 of the first thermal liner 106 and the inner surface 241 of the second thermal liner 108 define the insulated cavity 240. In various embodiments, the inner box 104 is positioned in the insulated cavity 240. In various embodiments, the inner surfaces 147,241 contact the outer surfaces of all the side walls of the inner box 104 when the nested insulated packaging assembly 100 is closed.

In various embodiments, a user positions the items 704 in the inner storage cavity 182 of the inner box 104. The divider 110 is positioned in the inner storage cavity 182 over the items 704. The user positions items 706 in the inner storage cavity 182 of the inner box 104 on the divider 110. Insertion of the divider 110 in the inner storage cavity 182 separates the inner storage cavity 182 into the upper chamber 700, the portion of the inner storage cavity 182 and the top end 162 of the inner box 104, and the lower chamber 702, the portion of the inner storage cavity 182 and the bottom end 164 of the inner box 104. In various embodiments, vent openings 214 in the divider 110 permit warm air to rise from the lower chamber 702 into the upper chamber 700 and cool air to settle from the upper chamber 700 into the lower chamber 702. In various embodiments, the temperature maintained in the upper chamber 700 may be different from the temperature maintained in the lower chamber 702, permitting packaging of items that need to be stored at different temperatures.

In various embodiments, the nested insulated packaging assembly 100 enables a transporter or deliverer to transport items to be shipped, such as the items 704 and items 706, in the inner box 104 positioned in the outer box 102 and remove the inner box 104 for the end user while retaining the outer box 102 and thermal liners 106,108 for reuse. In various embodiments, the deliverer may reuse the outer box 102 and thermal liners 106,108 with other inner boxes 104 for other customers. The deliverer may also more reliably recycle the outer box 102 and thermal liners 106,108 after delivery of the inner box 104 for the end user.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A nested insulated packaging assembly comprising:

an outer box including an outer top side wall, an outer bottom side wall, and a plurality of outer lateral side walls;

an inner corrugated cardboard portion positioned in the outer box, the inner corrugated cardboard portion including a plurality of inner lateral side walls, the plurality of inner later side walls defining a lateral outer surface and a lateral inner surface, the lateral inner surface disposed opposite from the lateral outer surface, the lateral inner surface at least partially defining an inner storage cavity within the inner corrugated cardboard portion, the lateral outer surface and the lateral inner surface each defined by corrugated cardboard;

a first thermal liner contacting the outer bottom side wall of the outer box; and a second thermal liner contacting at least a first outer lateral side wall, a second outer lateral side wall, and a third outer lateral side wall of the plurality of outer lateral side walls of the outer box and at least a first inner lateral side wall, a second inner lateral side wall, and a third inner lateral side wall of the plurality of inner lateral side walls of the inner corrugated cardboard portion, the second thermal liner contacting the lateral outer surface, the second thermal liner comprising a left fold, a front fold, and a right fold, the second thermal liner defining an inner surface and an outer surface, a thickness of the second thermal liner being defined between the inner surface and the outer surface, a portion of the outer surface defined by the left fold contacting the first outer lateral side wall, a portion of the inner surface defined by the left fold contacting the first inner lateral side wall, a portion of the outer surface defined by the front fold contacting the second outer lateral side wall, a portion of the inner surface defined by the front fold contacting the second inner lateral side wall, a portion of the outer surface defined by the right fold contacting the third outer lateral side wall, a portion of the inner surface defined by the right fold contacting the third inner lateral side wall, the second thermal liner defining a first bend line between the left fold and the front fold, the portion of the inner surface defined by the left fold being connected to the portion of the inner surface defined by the front fold at the first bend line, the second thermal liner defining a second bend line between the front fold and the right fold, the portion of the inner surface defined by the front fold being connected to the portion of the inner surface defined by the right fold at the second bend line, the left fold defining a left side end of the second thermal liner, the right fold defining a right side end of the second thermal liner, the left side end defined opposite from the right side end, the thickness being uniform from the left side end to the right side end.

2. The nested insulated packaging assembly of claim 1, wherein the first thermal liner and the second thermal liner are each C-shaped.

3. The nested insulated packaging assembly of claim 2, wherein:

the first thermal liner comprises a top fold, a back fold, and a bottom fold;

the inner corrugated cardboard portion further includes an inner top side wall and an inner bottom side wall;

the top fold contacts the inner top side wall;

the back fold contacts a fourth inner lateral side wall of the plurality of inner lateral side walls; and the bottom fold contacts the inner bottom side wall.

4. The nested insulated packaging assembly of claim 3, wherein:

the top fold contacts the outer top side wall;

the back fold contacts a fourth outer lateral side wall of the plurality of outer lateral side walls; and the bottom fold contacts the outer bottom side wall.

5. The nested insulated packaging assembly of claim 3, wherein the back fold is defined between the top fold and the bottom fold.

6. The nested insulated packaging assembly of claim 1, wherein the inner corrugated cardboard portion further includes an inner top side wall, wherein the inner top side wall defines a top outer surface, and wherein the top outer surface contacts the first thermal liner.

7. The nested insulated packaging assembly of claim 6, wherein the top outer surface is defined by corrugated cardboard.

8. The nested insulated packaging assembly of claim 1, wherein:

the inner surface extends unbroken from the left side end to the right side end; and the inner surface contacts the lateral outer surface.

9. The nested insulated packaging assembly of claim 8, wherein the inner surface is substantially planar when the second thermal liner is in an unfolded configuration.

10. The nested insulated packaging assembly of claim 1, wherein:

the inner corrugated cardboard portion further includes an inner bottom side wall; and the first thermal liner contacts the inner bottom side wall.

11. The nested insulated packaging assembly of claim 10, wherein the inner bottom side wall is attached to at least one of the plurality of inner lateral side walls.

12. The nested insulated packaging assembly of claim 1, wherein the second thermal liner comprises an insulation material, and wherein the insulation is a recycled, nonwoven, biodegradable material.

13. The nested insulated packaging assembly of claim 1, wherein the second thermal liner rests on at least a portion of the first thermal liner.

14. The nested insulated packaging assembly of claim 1, wherein the first bend line and the second bend line are vertically extending bending lines.

15. The nested insulated packaging assembly of claim 1, wherein:

the portion of the outer surface defined by the left fold is connected to the portion of the outer surface defined by the front fold at the first bend line, and the portion of the outer surface defined by the front fold is connected to the portion of the outer surface defined by the right fold at the second bend line.

16. The nested insulated packaging assembly of claim 1, wherein:

the second thermal liner comprises an insulation;

the insulation defines the inner surface and the outer surface; and the insulation extends through the first bend line and the second bend line.

17. A method of assembling a nested insulated packaging comprising:

positioning a first thermal liner in an outer box, the outer box including an outer top side wall, an outer bottom side wall, and a plurality of outer lateral side walls, the first thermal liner contacting the outer bottom side wall of the outer box;

folding a second thermal liner from an unfolded configuration to a folded configuration, the second thermal liner comprising a left fold, a front fold, and a right fold, the left fold defining a left side end of the second thermal liner, the right fold defining a right side end of the second thermal liner, the second thermal liner defining a first bend line between the left fold and the front fold, the second thermal liner defining a second bend line between the front fold and the right fold, the left fold, the front fold, and the right fold being substantially aligned in the unfolded configuration, the left fold being folded relative to the front fold about the first bend line and the right fold being folded relative to the front fold about the second bend line in the folded configuration, the second thermal liner defining an inner surface and an outer surface, a thickness of the second thermal liner defined between the inner surface and the outer surface, the thickness being uniform from the left side end to the right side end in the unfolded configuration; and positioning the second thermal liner in the outer box, the second thermal liner contacting at least a first outer lateral side wall, a second outer lateral side wall, and a third outer lateral side wall of the plurality of outer lateral side walls of the outer box, the second thermal liner resting on at least a portion of the first thermal liner, a portion of the outer surface defined by the left fold contacting the first outer lateral side wall, a portion of the outer surface defined by the front fold contacting the second outer lateral side wall, a portion of the outer surface defined by the right fold contacting the third outer lateral side wall.

18. The method of claim 17, wherein the nested insulated packaging further comprises an inner corrugated cardboard portion, the inner corrugated cardboard portion comprising a plurality of inner lateral side walls, the plurality of inner lateral side walls at least partially defining an inner storage cavity, a portion of the inner surface defined by the left fold contacting a first inner lateral side wall of the plurality of inner lateral side walls, a portion of the inner surface defined by the front fold contacting a second inner lateral side wall of the plurality of inner lateral side walls, a portion of the inner surface defined by the right fold contacting a third inner lateral side wall of the plurality of inner lateral side walls.

19. The method of claim 17, wherein:

the second thermal liner comprises an insulation;

the insulation is coupled to a layer of the second thermal liner;

the insulation comprises a first composition;

the layer comprises a second composition;

the first composition is different from the second composition;

the layer at least partially defines an insulated cavity;

folding the second thermal liner from the unfolded configuration to the folded configuration comprises folding the insulation and the layer about the first bend line and folding the insulation and the layer about the second bend line; and the insulation and the layer extend through each of the first bend line and the second bend line.

20. The method of claim 19, wherein the insulation is a recycled, nonwoven, biodegradable material.

21. The method of claim 17, wherein the portion of the inner surface defined by the left fold is connected to the portion of the inner surface defined by the front fold at the first bend line, and wherein the portion of the inner surface defined by the front fold is connected to the portion of the inner surface defined by the right fold at the second bend line.

22. A nested insulated packaging assembly comprising:

an outer box including an outer top side wall, an outer bottom side wall, and a plurality of outer lateral side walls;

a first thermal liner contacting the outer bottom side wall of the outer box, the first thermal liner at least partially defining an insulated cavity; and a second thermal liner resting on at least a portion of the first thermal liner, the second thermal liner further defining the insulated cavity, the second thermal liner comprising a left fold, a front fold, and a right fold, the left fold contacting a first outer lateral side wall of the plurality of outer lateral side walls, the front fold contacting a second outer lateral side wall of the plurality of outer lateral side walls, the right fold contacting a third outer lateral side wall of the plurality of outer lateral side walls, the second thermal liner defining a first bend line between the left fold and the front fold, the second thermal liner defining a second bend line between the front fold and the right fold, the second thermal liner comprising insulation coupled to a layer, the insulation comprising a first composition, the layer comprising a second composition, the first composition being different from the second composition, the layer facing the insulated cavity, the insulation and the layer extending through the first bend line and the second bend line, the second thermal liner defining an inner surface and an outer surface, the outer surface contacting the outer box, the inner surface at least partially defining the insulated cavity, a thickness of the second thermal liner being defined between the inner surface and the outer surface, the second thermal liner defining a right side end and a left side end disposed opposite from the right side end, the thickness being uniform from the right side end to the left side end.

23. The nested insulated packaging assembly of claim 22, wherein the inner surface extends unbroken form the left side end to the right side end.

24. The nested insulated packaging assembly of claim 23, wherein the inner surface is substantially planar when the second thermal liner is in an unfolded configuration.

* * * * *